US006126360A

United States Patent [19]

May et al.

[11] Patent Number: 6,126,360

[45] Date of Patent: Oct. 3, 2000

[54] RAISED RETROREFLECTIVE PAVEMENT MARKER

[75] Inventors: David C. May, Hudson, Wis.; Sithya S. Khieu, Eden Prairie; Cristina U. Thomas, Woodbury., both of Minn.; Warren J. Johnson, Hudson, Wis.; Ronald W. Gerdes, St. Paul; David J. Lundin, Woodbury, both of Minn.

[73] Assignee: 3M Innovative Properties Company, St. Paul, Minn.

[21] Appl. No.: 08/756,424

[22] Filed: Nov. 26, 1996

Related U.S. Application Data

[63] Continuation of application No. 08/445,285, May 19, 1995, abandoned.

[51] Int. Cl.[7] ..... E01F 9/06

[52] U.S. Cl. ..... 404/14; 404/16

[58] Field of Search ..... 404/9, 11, 12, 404/14, 15, 16; 359/531, 532, 534, 547, 551; 116/63 R

[56] References Cited

U.S. PATENT DOCUMENTS

| | | | |
|---|---|---|---|
| 2,666,373 | 1/1954 | Mattson | 404/16 |
| 2,699,982 | 1/1955 | Batterson | 404/15 |
| 3,427,933 | 2/1969 | Taylor-Myers | 404/9 |
| 3,712,706 | 1/1973 | Stamm | 350/103 |
| 3,717,076 | 2/1973 | Shields et al. | 94/1.5 |
| 3,924,929 | 12/1975 | Holmen et al. | 350/103 |
| 3,971,623 | 7/1976 | Hedgewick et al. | 350/103 |
| 4,070,095 | 1/1978 | Suhr | 350/103 |
| 4,232,979 | 11/1980 | Johnson, Jr. et al. | 404/16 |
| 4,340,319 | 7/1982 | Johnson, Jr. et al. | 404/16 |
| 4,349,598 | 9/1982 | White | 428/161 |
| 4,391,948 | 7/1983 | Falk et al. | 525/57 |
| 4,428,320 | 1/1984 | Oplt et al. | 116/63 R |
| 4,498,733 | 2/1985 | Flanagan | 350/102 |
| 4,726,706 | 2/1988 | Attar | 404/14 |
| 4,875,798 | 10/1989 | May | 404/12 |
| 4,895,428 | 1/1990 | Nelson et al. | 350/103 |
| 5,078,538 | 1/1992 | Montalbano | 404/9 |
| 5,244,946 | 9/1993 | Guest et al. | 524/86 |
| 5,267,809 | 12/1993 | Allan | 404/14 |
| 5,340,231 | 8/1994 | Steere et al. | 404/14 |
| 5,403,115 | 4/1995 | Flader | 404/9 |
| 5,460,115 | 10/1995 | Speer et al. | 116/63 P |
| 5,470,170 | 11/1995 | Lindner | 404/9 |

FOREIGN PATENT DOCUMENTS

| | | | |
|---|---|---|---|
| 0 171 030 | 2/1986 | European Pat. Off. | E01F 9/06 |
| 24 29 640 | 1/1975 | Germany | E01F 9/04 |
| 1028832 | 5/1966 | United Kingdom | E01F 9/06 |
| 2279681 | 1/1995 | United Kingdom | E01F 9/06 |
| WO/00709 | 1/1995 | WIPO | E01F 9/06 |

*Primary Examiner*—James A. Lisehora
*Attorney, Agent, or Firm*—Peter L. Olson

[57] ABSTRACT

A pavement marker has an unpotted upper shell and a lower base plate that together define a housing. A number of ribs are disposed in the housing interior oriented substantially perpendicular to the inner wall of the base plate. The upper shell has inclined end faces, an upper face, and is made of a plastic material having moderate to high flexural modulus and a high impact strength. The lower base plate has a planar inner wall and an opposed planar, pavement-engaging outer wall, and is made of a material having a Young's modulus of at least approximately 300,000 PSI ($20.7\times10^8$ Pascal). The ribs are formed unitarily with the inner wall of either the upper shell or the base plate, and extend upwardly from the inner wall of the base plate to the inner wall of the shell. A retroreflective lens is positioned on at least one of the first and second opposed side faces of the marker. The pavement marker resists delamination from a roadway surface when secured to the road with a soft adhesive.

4 Claims, 3 Drawing Sheets

RAISED RETROREFLECTIVE PAVEMENT MARKER

This is a continuation of application Ser. No. 08/445,285 May 19, 1995 now abandoned.

BACKGROUND OF THE INVENTION

1. Field of the Invention

The present invention relates to retroreflective raised pavement markers that are used for traffic markings and delineation, and more particularly to a durable raised pavement marker of high apparent modulus which possesses a high flexural modulus and impact strength to resist vehicle impact.

2. Related Art

Raised pavement markers are widely used as highway traffic markings for providing road lane delineation. One type of raised pavement marker is a retroreflective marker having a shell housing which is filled with a hard and brittle potting compound. These markers tend to sustain a high rate of breakage and shattering upon cyclic vehicle impact. However, at least one manufacturer of these markers has attempted to improve the durability of the housing. For instance, U.S. Pat. No. 5,340,231 to Steere et al. (assigned to the Stimsonite Corporation), teaches the use of chopped glass fiber reinforced block terpolymer acrylic-styrene-acrylonitrile for molding the housing but still fills the housing cavity with a rigid epoxy compound.

The use of high impact strength plastic material (i.e., a plastic material having an impact strength of higher than 1 foot-pound/inch as defined and measured by ASTM D1822) for making the housing has been practiced by the assignee of the present application, the Minnesota Mining and Manufacturing Company, Inc. ("3M") since the mid-1980's. Such use of high impact resistant material is disclosed in U.S. Pat. No. 4,875,798 to May (assigned to "3M"), and resulted in the commercialization of the high performance 3M model 280, SP280, 240, and SP240 markers.

SUMMARY OF THE INVENTION

It is a primary objective of this invention to provide a durable raised pavement marker having a retroreflective lens housed in an improved body construction that withstands impact from road traffic to achieve a long lasting marker. This is accomplished in part by providing avenues for redirecting the compressive and shear impact forces to tensile and compressive forces at the base of the marker.

It is another objective of this invention to provide an improved marker body design having a low profile and curved edges to minimize vehicle impact.

It is still another objective of this invention to provide an improved marker body design having finger grip slots for ease of handling.

It is still another objective of this invention to improve marker durability by using a composite construction.

It is yet another objective of this invention to improve marker road adhesion by using a composite construction including a molded, patterned, flat, and high Young's modulus base plate for reinforcing the stiffness of the marker housing and improving compatibility with a variety of adhesives including bitumen and epoxy.

It is another objective of this invention to produce a high apparent flexural modulus marker.

These and other objectives are achieved by providing a pavement marker comprising an unpotted (unfilled) upper shell and a lower base plate together defining a housing having an interior, and a plurality of ribs in the housing interior oriented substantially perpendicular to the inner wall of the base plate. The upper shell has inclined first and second opposed end faces, first and second opposed convex side faces, an upper face, a peripheral bottom surface, and an inner wall, and is made of a plastic material having a moderate to high flexural modulus, as defined below. The upper shell has a low profile and curved edges to minimize vehicle impact. The lower base plate has a planar inner wall and an opposed planar, pavement-engaging outer wall, and is made of a material having a Young's modulus of at least approximately 300,000 PSI ($20.7\times10^8$ Pascal), preferably greater than 400,000 PSI ($27.58\times10^8$ Pascal), and more preferably greater than 500,000 PSI ($34.48\times10^8$ Pascal). The base plate also preferably is made of a plastic material.

Young's modulus as used in the present application is defined and measured in accordance with ASTM D638, volume 08.01; and flexural modulus as used in the present application is defined and measured in accordance with ASTM D790. For the plastic materials used in the present invention, which can be either thermosetting or thermoplastic, a low modulus (either Young's or flexural) is considered to be less than 50,000 PSI ($3.45\times10^8$ Pascal) or less; a moderate modulus (either Young's or flexural) is considered to be 50,000 PSI ($3.45\times10^8$ Pascal) to 300,000 PSI ($20.7\times10^8$ Pascal); and a high modulus (either Young's or flexural) is considered to be above 300,000 PSI ($20.7\times10^8$ Pascal). By moderate to high flexural modulus is meant a flexural modulus encompassing both the moderate and high ranges, i.e., a flexural modulus of at least 50,000 PSI ($3.45\times10^8$ Pascal).

The ribs are formed unitarily with (i.e., formed as a single piece with) one of the inner walls (i.e., the inner wall of the upper shell or the inner wall of the base plate) and extend upwardly from the inner wall of the base plate to the inner wall of the shell to support the inner wall of the shell. A retroreflective lens is positioned on at least one of the first and second opposed side faces of the marker.

The upper shell preferably is made of a thermoplastic resin such as polycarbonate, and preferably includes about 15% to about 30% glass fiber reinforcement. The glass fiber reinforcement increases the flexural stiffness of the upper shell. The upper shell shape, material choice and rib spacing are preferably selected to allow ease of molding and to minimize material usage and expense. The base plate is selected to achieve a marker sufficiently stiff to resist flexure in use. The peripheral bottom surface of the shell can have a peripheral recess formed therein for receiving the base plate.

In a first embodiment in accordance with the invention, the ribs are formed unitarily with the inner wall of the shell. In a second embodiment in accordance with the invention, the ribs are formed unitarily with the inner wall of the base plate. Within each prototype, variations of the rib pattern are possible. In one rib pattern, the ribs can be arranged to extend longitudinally and transversely in a grid pattern. In another rib pattern, the ribs are divided into a first group in which the ribs are circular in shape and concentric, and a second group in which the ribs extend radially with respect to the first group.

In one aspect of the invention, the pavement marker has a minimum apparent modulus (as defined below) of about 80,000 PSI ($5.52\times10^8$ pascals), and preferably 100,000 PSI ($6.90\times10^8$ Pascal).

In another aspect of the invention, the first and second end faces are inclined at an angle of approximately 30°, and the first and second side faces are convex from top-to bottom and from end-to-end.

In yet another aspect of the invention, the first and second side faces have opposed recessed finger grip slots formed therein.

The present inventors have continued to expand the knowledge in the art of high performance markers by investigating road adhesion failure modes, in order to design a durable marker that adheres to the road with not only an epoxy type adhesive but also a bitumen adhesive. In order for a marker to flex or bend around a neutral axis, the upper body and ribs must compress, and the base elongate. When compression and elongation occur, a peel, or lifting, front is created which will eventually result in a bond failure of the marker. Failure may occur between the road surface and the adhesive or the marker base and the adhesive. "Peel front" is the term which we use to describe a tear in the bituminous adhesive (cohesive failure of the bitumen), failure of the bituminous adhesive from the base of the marker, or failure of the bituminous adhesive from the road surface. In the Finite Element Analysis ("FEA") which we conducted to study this phenomenon, "peel front" specifies the length of the tear and/or either of these types of failures. For example, in FIG. 8, the length of the peel front is represented by a set of nodes at the adhesive-road interface having negative reaction forces. These forces are tensile (or lifting) forces on the adhesive A. The horizontal and vertical loadings (forces) are indicated by reference letters X and Y, respectively.

We have developed a new marker construction in response to our investigations, to minimize the impact load, and reduce tire scuffing and dirt build up on the body. With impact force data which we collected for various, commercially-available markers, we conducted a comparative FEA, and discovered that the performance characteristics of the marker material have a significant effect on road marker adhesion; specifically, that there is a critical range of stiffness of the marker in which the marker will adhere well to the road with a soft adhesive.

One advantage of the high apparent modulus marker is the ability to choose and select materials that can be feasibly processed at high output volume by optimizing the construction combinations of moderate to high flexural modulus and high impact strength plastic materials for the housing, and materials for the base plate having a Young's modulus of at least approximately 300,000 PSI ($20.7\times10^8$ Pascal), preferably greater than 400,000 PSI ($27.58\times10^8$ Pascal), and more preferably greater than 500,000 PSI ($34.48\times10^8$ Pascal).

Accordingly, another advantage of the present invention is our ability to readily produce a light weight marker through a simple injection molding process. This process allows simple means of changing color and eliminates the need for filling the upper shell.

It is another advantage of this present invention to employ our knowledge of injection molding to optimize material usage by constructing the marker using the disclosed methodology and testing procedure.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
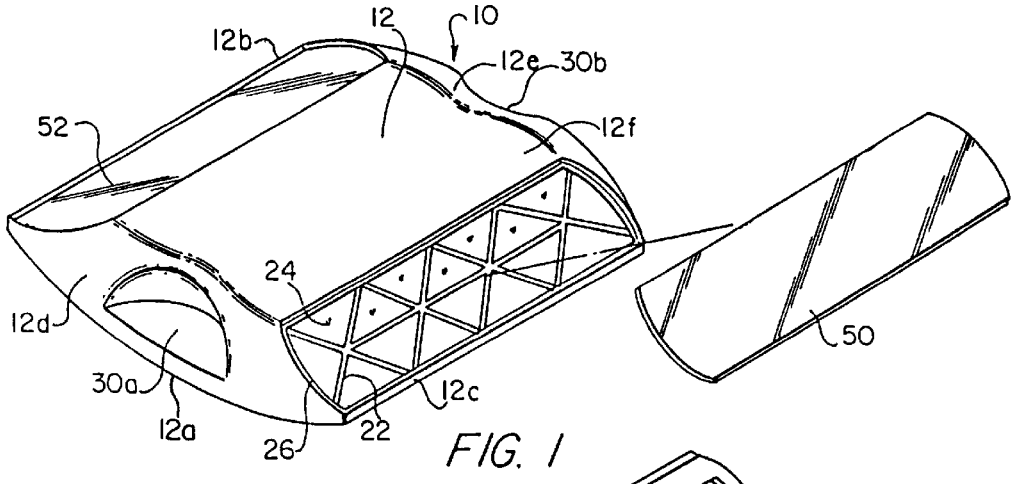
FIG. 1 is a top perspective view of a pavement marker in accordance with a first embodiment of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

The present invention results from our investigation of road adhesion failure modes of raised pavement markers, and our intent to design a durable marker that can be adhered to the road using a bitumen adhesive as well as an epoxy type adhesive. One of the initial steps taken in developing the present invention was to look at the amount of surface area on the bottom of the marker for bonding to the road. This involved the use of certain materials such epoxy, acrylic, styrene, etc. that were used to fill the spaces between the ribbings. We found that increasing the bonding surface area helps improve road adhesion, but not for a long enough duration. In some cases, our results showed that larger base area markers make shallower cuts into the adhesive than the smaller base area markers. This is referred to as the "cookie cutter" effect.

We also looked into increasing the bonding area by adding a flange-like base to the increase the size of the marker base. The results, surprisingly, showed poorer road retention than our standard marker. We also attempted to improve the road adhesion by making markers with other shapes similar to existing 3M and competitors'markers, but made from solid materials such polycarbonate and acrylonitrile butadiene styrene copolymer (ABS). The results were mixed. These 3M markers showed slight improvements relative to existing 3M markers; while competitive test markers performed worse than the existing competitive markers on which they were modelled, but somewhat better than the 3M test markers. The latter results triggered our hypothesis for improved marker road adhesion which includes not only the shape of the marker but also the material properties of the markers. We investigated our hypothesis by studying the impact forces, running FEA's, testing prototypes in the laboratory, and verifying the laboratory results in the field.

The relationship between the transmitted forces to the base of the marker (which leads to the marker road adhesion failure) and marker geometry was carefully studied. A very sensitive piezoelectric force transducer device was built to collect the vehicle impact forces both from our vehicle wear simulator (a laboratory test device which simulates an automobile tire running under load) and from actual cars and semi-trucks on a controlled test deck on Minnesota Highway 103. The study revealed surprising results about our existing 3M marker model 280 and the competitors'markers. The 3M markers actually carried a lesser load than the competitor's marker. These results further reinforced our original hypothesis about the role of the flexural property of the marker material. In addition to the effect of profile, the results also showed the dependency of tire collapse and type of car tires or semi-truck tires on the compressive forces. These impact force data allowed us to redesign the marker shape to minimize the impact load, and reduce tire scuffing and dirt build up on the body.

Figure 8:
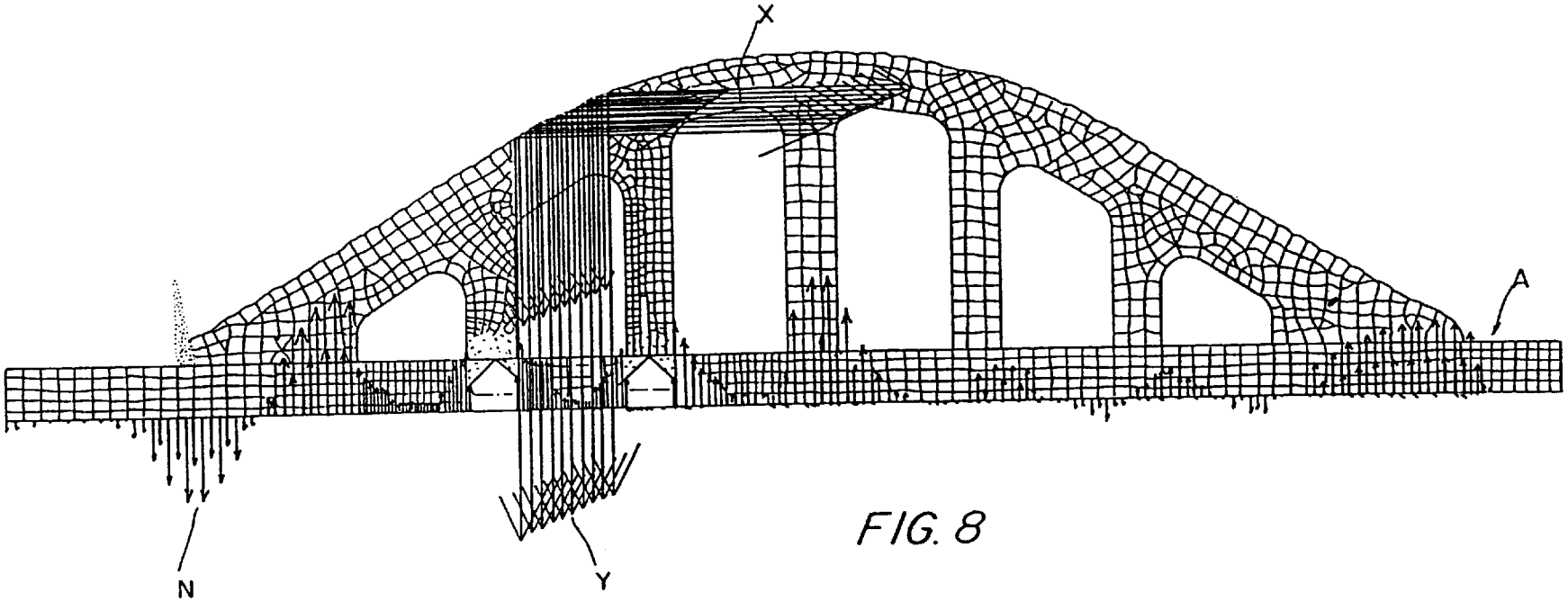
FIG. 8 is a diagram of a finite element model of initial tire impact and reaction forces on a 3M model 280 marker.

With the impact force data at our disposal, we conducted a comparative FEA on a typical competitor's marker and 3M's existing marker Model 280. The results again were surprising. First, they confirmed our suspicion about the bonded area. 3M's existing marker has a ribbed bottom surface. The ribbing causes some areas at the base to have tensile forces and some to have compressive forces; the effect is to rock the marker, eventually causing it to cut through the adhesive like a cookie cutter. These tensile forces are shown in FIG. 8. Second, there were two regions, one at leading edge and one at trailing edge of the marker, that sustain tensile (peeling or lifting) forces; this is especially obvious at the region closest to the impact locations.

These results explained why our high impact strength material does not perform as well with a soft adhesive such as bitumen, as compared to a hard adhesive such as epoxy; when epoxy is used as an adhesive to bond the marker to the road, the epoxy will solidify and become rigid at the base. This rigid bond prevents the marker from flexing, which controls the strain induced on the adhesive. With the soft adhesive, the marker body was allowed to flex; this flexing action in turn induces strain on the adhesive which will eventually tear the adhesive from the leading and trailing edges. In addition, the lack of bonding area diminishes the amount of adhesive pad underneath the marker through its cookie cutter action; therefore, the overall result is a performance unmatched to epoxy adhesive.

The next analysis we performed was to minimize the magnitude of flexure of the marker. We first made the marker solid, without ribbing, and analyzed it for lifting force. The results showed a reduction in the lifting forces and also led us to evaluate high flexural modulus material. The result again showed less lifting force as the flexural modulus is increased. In an attempt to reproduce these results in generally hollow or ribbed markers, we reinforced the base of the marker with a thin but high Young's modulus material; this resulted in the reduction of the peel forces. This was a significant finding that we could get an equivalent lifting force reduction with much less material. A Young's modulus of at least 300,000 PSI ($20.7\times10^8$ Pascal) at the marker base would prevent it from stretching, and therefore prevent the flexing action of the marker during impact. The FEA modeling further showed that with FR-4 laminate material (available from Allied Signal Laminate Systems Inc.) of just 0.090 inch (0.229 cm) thickness, the new design sustained lower lifting forces than the competitor's marker giveh the same loading condition.

Based on the results of our testing, two prototype molds were built for molding with six different shell materials and six different base plate materials. Both prototypes are characterized by having in common an unpotted (unfilled) upper shell and a lower base plate together defining a housing having an interior, and a plurality of ribs in the housing interior oriented substantially perpendicular to the inner wall of the base plate. The upper shell has inclined first and second opposed end faces, first and second opposed convex side faces, an upper face, a peripheral bottom surface, and an inner wall, and is made of a plastic material having moderate to high flexural modulus with a high impact strength. The upper shell has a low profile and curved edges to minimize the shear component resulting from vehicle impact. The lower base plate has a planar inner wall and an opposed planar, pavement-engaging outer wall, and is made of a material having a Young's modulus of at least approximately 300,000 PSI ($20.7\times10^8$ Pascal), preferably greater than 400,000 PSI ($27.58\times10^8$ Pascal), and more preferably greater than 500,000 PSI ($34.48\times10^8$ Pascal). The ribs are formed unitarily with one of the inner walls (i.e., the inner wall of the upper shell or the inner wall of the base plate) and extend upwardly from the inner wall of the base plate to the inner wall of the shell to support the inner wall of the shell. A retroreflective lens is positioned on at least one of the first and second opposed side faces of the marker.

The ribs provide the structural stability for the marker housing with the use of very little material. They function in a manner similar to a frame structure in a three-dimensional plane. A cross-section of the marker taken along a plane parallel to the base reveals a three-dimensional truss-like network of members which, in a preferred embodiment, have a triangular geometry. These ribs are similar to the slender members which act to support both the shear and compressive forces resulting from vehicular impact, and like a frame structure, the ribs carry the axial load mainly resulting from compressive load, as well as the shear force and the moment about each connecting rib.

The upper shell can include sufficient pigment to achieve a desired color. The base plate is made of a material having a Young's modulus of at least approximately 300,000 PSI ($20.7\times10^8$ Pascal), preferably greater than 400,000 PSI ($27.58\times10^8$ Pascal), and more preferably greater than 500,000 PSI ($34.48\times10^8$ Pascal), to resist the applied forces. The upper shell shape, material choice and rib spacing are selected to allow ease of molding and to minimize material usage and expense. The base plate is selected to achieve a marker sufficiently stiff to resist flexure in use. One base plate which fulfills this requirement is an epoxy impregnated fiber glass mat. Other base plates can be molded from thermoplastic matrices into which glass mats are inserted; possible thermoplastic and glass mat combinations are Lexan 3412 and JPS glass mat 1362 (available from JPS Fabrics, a Division of JPS Converter and Industrial corporation of Slater, S.C.), Lexan 3412 and JPS glass mat 1358 (also available from JPS Fabrics), and Lexan 3412 and JPS glass mat 1353 (available from JPS Fabrics).

The lens is made of a material selected to achieve the desired retroreflective properties and to bond to the upper shell. A suitable example is found in U.S. Pat. No. 4,875,798 to Nelson. The lens can be attached with a suitable adhesive, but more preferably is welded to the marker body, for example by ultrasonic or vibration welding, to achieve a seal.

The two prototypes differ in the location of the ribs. In the first prototype in accordance with the invention, the ribs are formed unitarily with the inner wall of the shell. In the second prototype in accordance with the invention, the ribs are formed unitarily with the inner wall of the base plate.

Within each prototype, variations of the rib pattern are possible, as described in greater detail hereinafter.

The second prototype allows for a greater percentage of the total material to be covered by the upper shell. A recycled plastic of similar base material can then be used to the maximum extent for the ribs and base plate, without regard to its color and appearance, while a virgin plastic material can be used for the upper shell. In this way, the visible portion of the marker, i.e., the upper shell, can still be controlled as to color and appearance, while achieving a total lower cost and an excellent outlet for what would otherwise be waste material. Vibration welding preferably is used because it can assemble parts of the size being used and tolerate inequities in flatness and material composition; also, it provides a better bond than adhesives.

A large number of samples were made under our direction, using these new prototype molds. The samples and some commercially available markers were tested to validate the FEA results. Some of these samples are described in the Examples below and are summarized in accompanying Table. The test results for these samples are summarized in the accompanying Table. The samples which are described in the Examples are considered illustrative of the many that were made, and should not be considered as limiting the invention in any way.

Since each marker construction was different, the only way to achieve comparable test results was by means of a device which normalized the dimension(s) of the markers. The ASTM test method D790 describes the testing of material for flexural modulus. This test method is employed in measuring the flexural modulus of the marker with Method I and Procedure A. ASTM D790 also specifies the dimensions of the sample, and the equation necessary for calculating the flexural modulus. The span in ASTM D790 and section 6.2.1 is specified as being 16 times the sample thickness. The geometries of the raised pavement markers differ from this dimensional ratio. Therefore, in order to obtain a uniform and comparable test result among the different raised markers which we tested, the span of the marker was fixed at 1.85 inches (4.70 cm) to accommodate all the various types of markers. The introduction of this fixed span also insured that the effect of the shear in the modulus calculation was uniform for all markers. This normalized modulus is referred to as apparent flexural modulus, or apparent modulus. The apparent modulus is a number expressed in pounds per square inch (PSI) or Pascal (Pa) which represents the flexural modulus of the marker and which is specific to that marker. The values of the apparent modulus allow us to rank the markers' ability to withstand flexing caused by vehicle impact.

In accordance with ASTM test method D790, the flexural modulus test was conducted on a computer-interfaced material testing machine MTS model 810 with a pair of MTS model 632.17B-20 extensometers. The samples were placed on two supports as described in ASTM D790 for a three-point bending mode. The dimensions of the sample thickness and length were the marker thickness and the marker length, and the span was 1.85 inches (4.70 cm), in order to maintain the same shear effects for all marker samples during measurement. The pair of extensometers were used to measure the deflection of each marker at the bottom. The needles of the extensometers were pointed along the centerline, on the marker bottom adjacent to the areas under the inclined faces. The extensometers were used to take high accuracy deflection measurements. High accuracy deflection measurements were necessary because some markers have a composite construction of a plastic shell housing and/or body enclosing potting materials or closed by a base plate which when put under load will deform more from the top than the bottom side. The high precision extensometers were used to measure deflection at the base because the flexing that causes the damage to the adhesive/road, adhesive/adhesive, and adhesive/marker base interfaces occurs at the base of the markers.

The MTS was set to load on the top center of the marker up to a maximum force of 1,000 lbs and the deflection rate was set at 0.1 inch (0.25 cm) per minute. The deflection rate was calculated from the equation given in section 9.1.3 of ASTM D790.

The measured forces and deflections were plotted, and the slope was calculated to obtain the modulus. The marker dimensions differed from marker to marker. Therefore, the only way to obtain comparable data was to normalize by the marker thickness and length. The apparent modulus was determined by the following equation specified in ASTM test method D790:

$$E=span^3 \times slope/(4 \times length \times thick^3),$$

where:

span=1.85 slope=change in load/change in deflection at bottom relative to supports length=length of marker thick=thickness of marker The laboratory testing demonstrates that we can readily use a moderate to high flexural modulus plastic material for the upper shell and a material having a Young's modulus of at least approximately 300,000 PSI ($20.7\times10^8$ Pascal), preferably greater than 400,000 PSI ($27.58\times10^8$ Pascal), and more preferably greater than 500,000 PSI ($34.48\times10^8$ Pascal) for the base plate to construct the marker to obtain a high apparent modulus marker. The testing further shows that, for the marker to adhere well using a soft adhesive, such as bitumen, it should have a minimum apparent modulus of approximately 80,000 PSI ($5.52\times10^8$ pascals) No upper limit is presently known, beyond which an increase in the apparent modulus may not produce much benefit in terms of increased adhesion performance. We conducted tests on 3M's confidential test deck in the one of the "sun belt" states in order to confirm this. The test results consistently validate our theory losses are minimized where the marker is constructed to have a high apparent modulus and losses increase in the low apparent modulus marker. The field data also shows the benefits of having a combination of a flat base and high apparent modulus in the marker's ability to resist the "cookie cutter" effect.

EXAMPLE 1

Figures 5, 6, 7, 9, 10, 11:
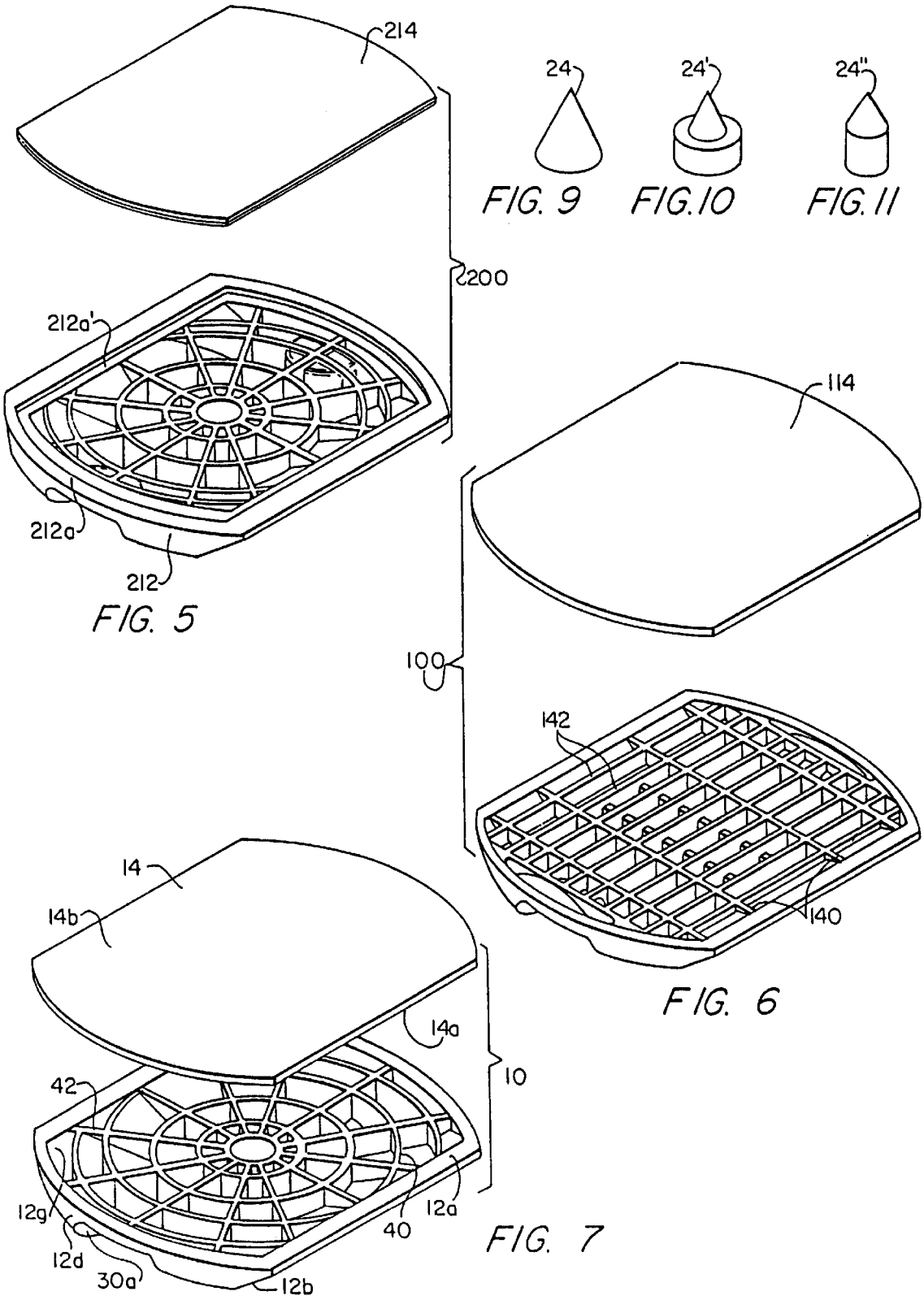
FIG. 5 is bottom perspective view of the marker of FIG. 1, with the base plate exploded off to show a first rib pattern and a peripheral recess in the bottom peripheral surface of the upper shell.
FIG. 6 is bottom perspective view of a second embodiment of a pavement marker in accordance with the invention, with the base plate exploded off to show a second rib pattern.
FIG. 7 is bottom perspective view of a third embodiment of a pavement marker, with the base plate exploded off.
FIG. 9 is a first embodiment of a single energy director.
FIG. 10 is a second embodiment of a single energy director.
FIG. 11 is a third embodiment of a single energy director.

The principle of marker road adhesion involves a high flexural modulus and high impact strength plastic marker material which can withstand vehicle impacts. In a first embodiment of the invention, a marker 10 with these properties is made feasible by utilizing existing and commercially available plastic materials which by themselves would not have sufficient flexural strength to resist the applied load. With reference to FIGS. 1 and 7, this is accomplished by molding a high impact upper shell 12 and reinforcing it with a lower base plate 14 having a Young's modulus of at least approximately 300,000 PSI ($20.7\times10^8$ Pascal), preferably greater than 400,000 PSI ($27.58\times10^8$ Pascal), and more preferably greater than 500,000 PSI ($34.48\times10^8$ Pascal). The upper shell 12 is injection molded from a moderate to high flexural modulus and high impact strength polycarbonate material, in the case of Example 1, Lexan 141 (Lexan is a trademark for thermoplastic carbonate-linked polymers produced by reacting bisphenol A and phosgene; Lexan 141 is available from GE Plastics of Pittsfield, Mass.). Preferably, upper shell 12 has a 0.080 inch (0.203 cm) maximum thickness.

Upper shell 12 includes a peripheral bottom surface 12*a*, two mirror image inclined end faces 12*b* and 12*c*, two convexly curved side faces 12*d* and 12*e* adjacent end faces 12*b* and 12*c*, an upper face 12*f*, and an inner wall 12*g*. As shown in FIGS. 1 and 7, side faces 12*d* and 12*e* are convexly curved both from end-to-end and from top to bottom.

End faces 12*b* and 12*c* are recessed, and have molded ultrasonic energy directors 22, 24, and 26 protruding upwardly therefrom. Semi-elliptical recessed finger grips slots 30*a* and 30*b* are formed in side faces 12*d* and 12*e* adjacent inclined end faces 12*b* and 12*c*. The bottom surfaces of slots 30*a* and 30*b* are approximately 0.25 inch (0.64 cm) above the bottom surface of marker 10.

Lower base plate 14 has a planar inner (upper) wall 14*a* and an opposed planar, pavement-engaging outer (lower) wall 14*b* and is made from a 1/16 inch (0.159 cm) Allied Signal composite laminate FR-4 material. Lower base plate 14 has a periphery the same shape as the peripheral bottom surface 12*a* of upper shell 12, and the inner wall 14*a* of lower base plate 14 is attached to the peripheral bottom surface 12*a* of upper shell 12 using an adhesive. In the case of Example 1, the adhesive is 3M quick set Jet-Weld™ TE-031 thermoset adhesive.

Concentric circular ribs 40 protrude from the inner wall 12*g* of upper shell 12 and terminate in a plane coplanar with peripheral bottom surface 12*a*. Radial ribs 42 also protrude from inner wall 12*g* and are connected to circular ribs 40. Radial ribs 42 are spaced approximately 30° about the common center of circular ribs 40, and also terminate in the same plane as circular ribs 40.

Two retroreflective elements such as lenses 50 and 52 are ultrasonically welded to upper shell 12 through the energy directors 22, 24, and 26 extending upwardly from inclined faces 12*b* and 12*c*. The use of energy directors for the ultrasonic welding of retroreflective lenses is described in U.S. Pat. No. 4,875,798, which is incorporated herein by reference in its entirety. Lenses 50 and 52 and energy directors 22, 24, and 26 are dimensioned so that the upper surfaces of lenses 50 and 52 are substantially level with the surrounding outer surface of supper shell 12.

Energy directors 22 are in the form of septa that define cells therebetween, and energy directors 24, which are in the form of pillars located within the cells. Energy directors 24 can be conical, as shown in FIG. 9, they can be in the form of a cone superimposed on a cylinder, as indicated by reference numerals 24' and 24" shown in FIGS. 10 and 11, or any other shape which provides a point contact with the lenses 50 and 52. At least some of energy directors 22 are arranged in triangular patterns. Although energy directors 22 can also be arranged in rectangular, trapezoidal, and other geometric patterns, the triangular pattern is structurally the most stable of these geometric patterns.

Energy directors 24 provide extra support along the top cells. This extra support is desirable because a vehicle tends to impact marker 10 about one-third the distance from the top area. With energy directors 22 alone, the lenses can still break with repeated impacts. Adding the singular energy directors 24 provides additional support. An added advantage of energy directors 24 is that they minimize the loss of retrorefectivity. At every weld line, cube corners of the retroreflective lens structure are destroyed. Singular energy directors 24 minimize the weld lines while providing enough support to withstand vehicle impacts.

Energy director 26 is provided inside the perimeter of end faces 12*a* and 12*b*. Energy director 26 has a height slightly greater than that of energy directors 22 and 24, in order to hermetically seal the perimeter of the lenses, to protect them from moisture. It has been found that the perimeter energy director 26 should be raised above the tops of the other, interior energy directors 22 and 24 by an amount about equal to the cube corner lens height. The cells defined by energy directors 22 contain contamination, in case part of a lens breaks.

Marker 10 has a low profile and curved edges to minimize vehicle impact. Thus, and by way of illustration only, an exemplary marker 10 has a height of about 0.625 inch (1.59 cm), a side-to-side width (across side faces 12*d* and 12*e*) at its widest point of about 4.00 inches (10.2 cm), and an end-to-end length (across end faces 12*b* and 12*c*) of about 3.5 inches (8.9 cm). End faces 12*b* and 12*c* are inclined at an angle of about 30° to bottom surface 12*a* and at their junctions with bottom surface 12*a* are curved on a radius of about 0.031 inch (0.079 cm). Upper face 12*f* is curved on a radius of about 6.45 inches (16.383 cm). Side faces 12*d* and 12*e* are curved from top to bottom on a radius of about 0.750 inch (1.905 cm) and from side to side on a radius of about 3.00 inches (7.62 cm); they terminate about 0.575 inch (1.461 cm) above bottom surface 12*a*. The bottom surfaces of finger grip slots 30*a* and 30*b* are inclined at an angle of about 13° to bottom surface 12*a* and terminate about 0.14 inch (0.36 cm) above bottom surface 12*b*; the upper edges are curved at their junction with side faces 12*d* and 12*e* on a radius of about 0.06 inch (0.15 cm).

EXAMPLE 2

The marker of Example 2 is like marker 10 of Example 1 except that the base plate is an FR-4 laminate (a glass mat impregnated with epoxy) and is about 1/8 inch (0.318 cm) thick.

EXAMPLE 3

The marker 100 of Example 3 (shown in FIG. 6) is like marker 10 of Example 1 except that it has longitudinal ribs 140 and transverse ribs 142 forming a grid pattern.

EXAMPLE 4

The marker of Example 4 is like the marker of Example 2 except that the ribs are longitudinal and transverse, as in the marker of Example 3.

EXAMPLE 5

The marker 200 of Example 5 (shown in FIG. 5) is like marker 10 of Example 1, except that it has an injection molded base plate 214 made of a 20% glass filled polycarbonate Lexan 3412 material (Lexan 3412 is available from GE Plastics), the peripheral bottom surface 212*a* of upper shell 212 has a recess 212*a'* therein to receive base plate 214, and base plate 214 is vibration welded to upper shell 212 in the recessed area 212*a*, instead of being fixed using a thermoset adhesive.

EXAMPLE 6

Figure 2:
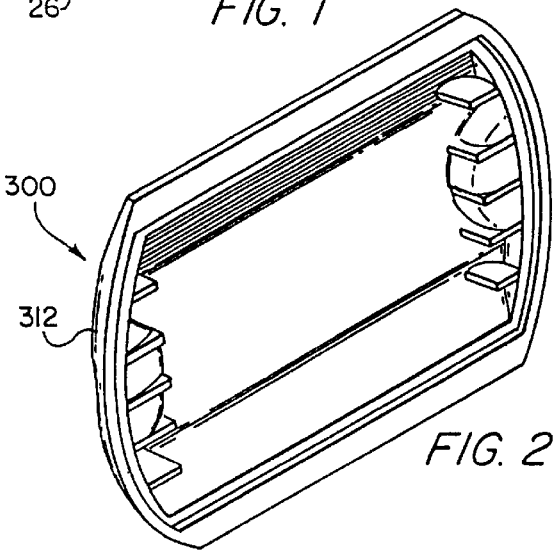
FIG. 2 is a perspective view of the underside of an upper shell of a pavement marker in accordance with a second embodiment of the present invention.
Figure 3:
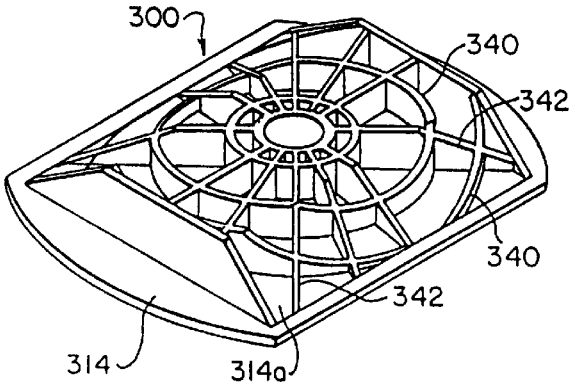
FIG. 3 is a top perspective view of a lower base plate having a first rib pattern for use with the upper shell of FIG. 2.
Figure 4:
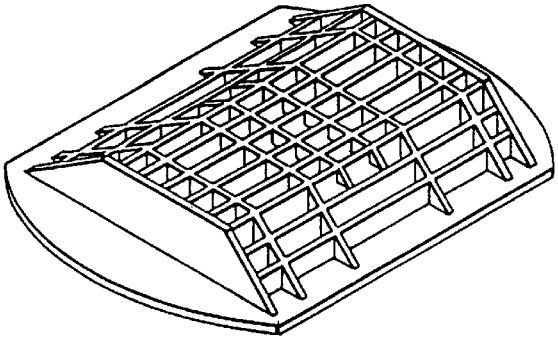
FIG. 4 is a top perspective view of a lower base plate having a second rib pattern for use with the upper shell of FIG. 2.

The marker 300 of Example 6 (shown in FIGS. 2 and 3) is like marker 10 of Example 1, except that upper shell 312 is hollow, concentric ribs 340 and radial ribs 342 extend perpendicularly from inner wall 314*a* of base plate 314, ribs 340 and 342 and base plate 314 are molded as a unit from Lexan 3412, and base plate 314 is vibration welded to upper shell 312. Although not constructed for these tests, the base plate can also be configured with ribs extending transversely and longitudinally as shown in FIG. 4.

EXAMPLE 7

The marker of Example 7 is like marker 10 of Example 1, except the base plate is made from extruded Lexan 141 on a fiber glass scrim, and the base plate is vibration welded to the upper shell.

EXAMPLES 8 through 13

The markers of Examples 8–13 are like the markers of Examples 1–6, except the upper shells are molded from Lexan 3412.

EXAMPLE 14

The marker Example 14 is like marker 10 of Example 1 except the housing is molded from Lexan 3413 material (Lexan 3413 is available from GE Plastics).

EXAMPLE 15

The marker of Example 15 is like the marker of Example 2 except the housing is molded from Lexan 3413 material.

EXAMPLE 16

The marker of Example 16 is like marker 10 of Example 1 except the housing is molded from Durethan BKV 130 material (a glass-reinforced, impact-modified polyamide with 30% glass, which is commercially available from Bayer Inc. (formerly Miles, Inc.) of Pittsburgh, Pa.).

EXAMPLE 17

The marker of Example 17 is like the marker of Example 2 except the housing is molded from Durethan BKV 130 material.

EXAMPLE 18

The marker of Example 18 is like marker 100 of Example 3 except the housing is molded from Entec N1033E1 material (a nylon which is 33% glass filled, which is commercially available from Entec Polymer Inc.).

EXAMPLE 19

The marker of Example 19 is like marker 10 of Example 1 except the housing is molded from Xenoy 6370 material (which is commercially available from GE Plastics).

EXAMPLE 20

The marker of Example 20 is like the commercially available 3M 280 marker except it is made with FR-4 laminate 1/16 inch (0.16 cm) base plate glued to the upper shell with 3M Jet-Weld™.

EXAMPLE 21

The marker of Example 21 is like the commercially available model 911 marker from Stimsonite, which is a shell-type marker having an injection molded upper shell with potting fillers which consist of epoxy, glass beads and sand.

EXAMPLE 22

The marker of Example 22 is the commercially available marker from Pac-Tech (Apex marker model 918), which is a shell-type having an injection molded upper shell with epoxy-sand potting filler.

EXAMPLE 23

The marker of Example 23 is the commercially available Swareflex marker, which has a thick-walled, injection molded body with longitudinal and transverse ribbing patterns.

EXAMPLE 24

The marker of Example 24 is the commercially available RayOlite marker model 8704(S), which is a shell-type having epoxy-sand compound as a potting filler.

EXAMPLE 25

The marker of Example 25 is like the marker of Example 6, except that it has a 0.055 inch (1.4 mm) injection molded base plate 214 having a glass mat. The apparent modulus for this marker does not show any improvement because when the sample was molded, four pin holes were created approximately at the four corners of the marker, and a 1 inch (2.54 cm) hole was created in the center of the mat. The four pins were used to hold the mat in the mold and the hole in the mat was necessary to allow the material to shoot into the cavity without moving the glass mat. In addition, the glass mat was not adequately impregnated on the bottom of the base plate. The holes in the base plate and the glass mat are believed to have weakened the structure for purposes of the flexural modulus test. However, the glass mat still appears to help reinforce the base of the marker, in that the sample achieved about the same modulus as the unreinforced base of the marker of Example 6.

The results of the apparent modulus measurements and calculations are set forth in the accompanying Table. The data in the Table clearly demonstrates that high apparent modulus thermoset injection molded markers can be achieved through the use of a high modulus reinforcing base plate; further, it demonstrates that these apparent moduli are in the region of the comparable, monolithic, rigid and brittle type of markers, except that these high modulus base plate markers achieve a high impact resistance which allows them to withstand an impact force which is orders of magnitude higher than these other brittle markers. The base plates for over half of these prototype markers were attached using an adhesive, which was adequate to get a sense of the magnitude of the modulus which can be achieved. However, we also investigated the effect of the method of attaching the upper shell to the base plate. For example, the markers of Examples 1–5, 8–11, and 14–19 were assembled using hot melt adhesive. In practice, the base plates preferably are vibration welded to the housing. Vibration welding increases the bonding strength by orders of magnitude.

In addition, we also investigated the effect of the attachment methods that were used for putting the base to the markers. The Example 6 marker utilizes the vibration welding process for attaching the base plate to the marker housing. Though the base plate was only made from lower modulus plastic material, the apparent modulus obtained was much higher than, say, that of the Example 1 marker where the FR-4 laminate material has a much higher flexural modulus. This would explain why the increase in the thickness of the FR-4 laminate shows only minimal increase in the apparent modulus; it is because the load transfer was not being optimized due to the delamination in the adhesive.

Various types of retroreflective lenses and methods of attachment are envisioned as being suitable for use in the marker. Detailed descriptions of suitable retroreflective lenses are provided in U.S. Pat. Nos. 3,712,706, 4,875,798, and 4,895,428 to Nelson et al.; U.S. Pat. No. 3,924,929 to Holmen, U.S. Pat. No. 4,349,598 to White, and U.S. Pat. No. 4,726,706 to Attar, all of which are incorporated herein by reference in their entireties.

In a first embodiment, the lens system is made by placing a sheet of clear polycarbonate (commercially available from GE Plastics of Pittsfield, Mass.) on a cube corner tooling, applying heat and pressure, and then allowing the sheet to cool, thus forming microcube corner sheeting. This sheeting is die cut into lens pieces, which can then be used in one of two ways. In the first way, the lens piece is ultrasonically welded into the slots in the housing. These slots contain energy directors molded in generally triangular patterns selected to optimize the structural integrity of the lens against vehicle impact and the retroreflectivity of the lens. In the second way, an aluminum vapor coat is deposited on the lens piece. The lens piece is then adhered to the end faces of the upper shell using, for example, a pressure sensitive adhesive. When the lens piece is provided with an aluminum vapor coat, the end faces of the upper shell are not provided with energy directors.

The first way provides a marker having a brighter lens, the lens in accordance with the second embodiment losing about 40% of its brightness due to the aluminum vapor coat. Although the lens of the first embodiment will lose some of its brightness, it loses far less than that of the second embodiment. In addition, it has permanently moisture-sealed pocket regions which are defined by the energy director pattern.

In a third embodiment, the lens can be made using an injection molding process. The microcube corner tool is cut in the shape of the lens piece, with the energy director pattern formed on each individual lens. Therefore, when each lens is molded, it contains the proper shape without the necessity of die cutting, and also includes built-in energy directors. The lens system in accordance with the third embodiment also eliminates the need for an energy director pattern formed on the end faces of the upper shell; the end face of the upper shell thus are provided with planar faces. The ultrasonic energy directors formed on the lens provide a benefit, in that the lens brightness can be designed in accordance with the number of cubes that will be available. In the case where the energy directors are formed on the end faces, there is no way to predict the number of cubes which will be destroyed in the ultrasonic welding process. Forming the lens by injection molding with integral energy directors controls destruction of the cubes during welding because the amount of cube loss is determined during the design of the lens. The lenses with integral energy directors can be ultrasonically welded to the end faces of the upper shell in the same way as the lenses without the integral energy directors, by placing the lens in the open end face.

Modifications and variations of the above-described embodiments of the present invention are possible, as appreciated by those skilled in the art in light of the above teachings. For example, the grid pattern for the ribbing can be varied by changing the radius at the intersections of the longitudinal and transverse ribs and at the junction of the ribs with the inner wall of the upper shell. Comparative testing of prototypes with larger radii (approximately 0.062 inch (0.157 cm)) and prototypes smaller radii (approximately 0.031 inch (0.079 cm)) indicates that a rib pattern with larger radii resists fatigue stress better. However, comparative testing with the rib pattern comprising concentric and radial ribs indicates that the concentric/radial pattern is stronger than either grid pattern.

It is therefore to be understood that, within the scope of the appended claims and their equivalents, the invention may be practiced otherwise than as specifically described.

What is claimed is:

1. A raised pavement marker comprising:

(a) a convex, generally hollow shell having inclined first and second opposed end faces and a peripheral bottom wall;

(b) a base plate having an inner wall and a pavement-engaging outer wall, said base plate being joined to the peripheral bottom wall at the periphery of each;

(c) a plurality of ribs oriented substantially perpendicular to the inner wall of said base plate; and d) a retroreflective lens positioned externally of the shell on at least one of said first and second opposed end faces at least one of said end faces having first and second pluralities of energy directors molded therein and extending upwardly therefrom, and the lens welded thereto, said first plurality of energy directors being in the form of septa defining a plurality of cells and said second plurality of energy directors being in the form of individual pillars located in at least some of said cells.

2. The pavement marker of claim 1, wherein at least an upper portion of said pillars are conical in shape.

3. The pavement marker of claim 1, further comprising a peripheral energy director positioned inside the perimeter of said at least one end face, said peripheral energy director having a height greater than that of said first and second pluralities of energy directors.

4. The pavement marker of claim 3, wherein said lenses are cube corner retro-reflective lenses, and wherein said peripheral energy director is raised above the tops of said first and second pluralities of energy directors by an amount about equal to the cube corner lens height.

* * * * *

UNITED STATES PATENT AND TRADEMARK OFFICE

CERTIFICATE OF CORRECTION

PATENT NO. : 6,126,360
DATED : October 3, 2000
INVENTOR(S) : May, David C.

It is certified that error appears in the above-identified patent and that said Letters Patent is hereby corrected as shown below:

Title page,
Item [56], FOREIGN PATENT DOCUMENTS, please delete "2279681" and insert in place thereof -- 2279681A --.

Column 5,
Line 48, delete "force" and insert in place thereof -- forces --.

Column 13,
Line 46, delete "face" and insert in place thereof -- faces --.

Signed and Sealed this

Seventeenth Day of June, 2003

JAMES E. ROGAN
*Director of the United States Patent and Trademark Office*